United States Patent [19]

De Cola

[11] 4,133,146

[45] Jan. 9, 1979

[54] ROTARY ABRASIVE TOOL

[76] Inventor: Charles R. De Cola, 10913 National Blvd., West Los Angeles, Calif. 90064

[21] Appl. No.: 808,965

[22] Filed: Jun. 22, 1977

[51] Int. Cl.[2] ..... B24D 13/04

[52] U.S. Cl. ..... 51/336; 51/355; 51/364; 51/382

[58] Field of Search ..... 51/330–337, 51/355, 364–369, 382, 383, 384, 386, 388; 15/230.16, 230.19

[56] References Cited

U.S. PATENT DOCUMENTS

| | | | |
|---|---|---|---|
| 437,463 | 9/1890 | Teague | 51/364 |
| 734,581 | 7/1903 | Lockwood | 51/364 |
| 739,028 | 9/1903 | Rollins | 51/364 |
| 1,118,153 | 11/1914 | Sanborn | 51/336 X |
| 2,259,685 | 10/1941 | Elsloo | 51/364 X |
| 2,440,856 | 5/1948 | Harrison | 51/337 |
| 2,519,556 | 8/1950 | Fish | 51/336 X |
| 2,771,720 | 11/1956 | Field | 51/337 |
| 2,871,632 | 2/1959 | Cosmos | 51/337 |
| 3,141,269 | 7/1964 | Block | 51/337 |
| 3,496,684 | 2/1970 | Banning | 51/334 |
| 3,512,311 | 5/1970 | Block | 51/334 |
| 3,678,633 | 7/1972 | Block | 51/337 |

OTHER PUBLICATIONS

C. E. Wolfe, *American Machinist,* "Abrasive Cloth in Cotter Pin", 9-24-56, p. 148.

*Primary Examiner*—Nicholas P. Godici
*Attorney, Agent, or Firm*—Freilich, Hornbaker, Wasserman, Rosen & Fernandez

[57] ABSTRACT

A rotary mandrel which can directly engage sandpaper or other wearing material, to eliminate the need for intermediate devices to couple the mandrel to the sandpaper. The mandrel is constructed with slots that closely receive the edges of the sandpaper to form an interference fit that has been found to avoid flying out of the sandpaper when the mandrel rotates and engages the work piece being sanded. The mandrel is tapered at its outer end, and the sandpaper holding slots have open outer ends that allow the sandpaper sheets to extend beyond the tapered mandrel end, which enables the sheets to deform into a cone shape to sand a small hole or other concave workpiece region. In one mandrel, a group of sheets are stapled together along the edge, and the staple lies in an undercut slot in the mandrel.

5 Claims, 20 Drawing Figures

FIG. 6
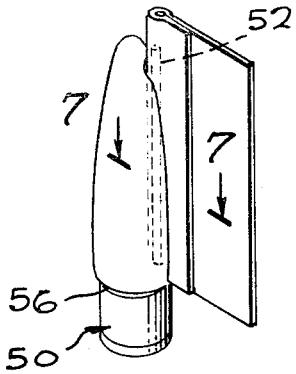
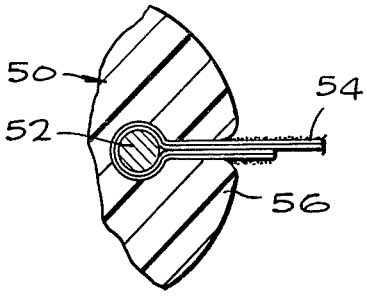
FIG. 7
FIG. 9
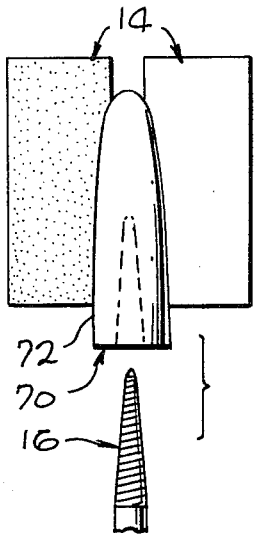
FIG. 8
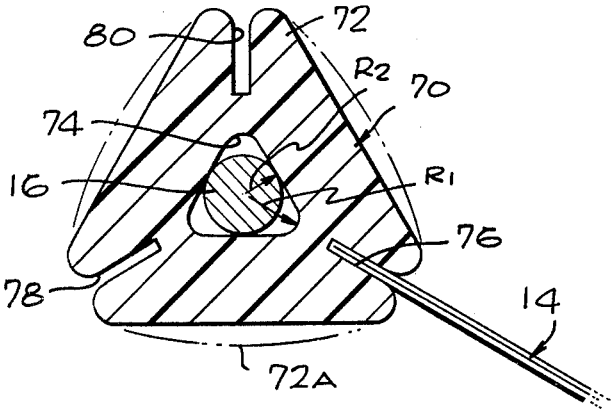
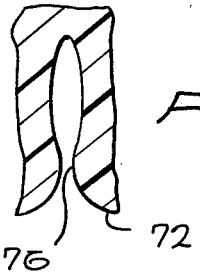
FIG. 10
FIG. 11
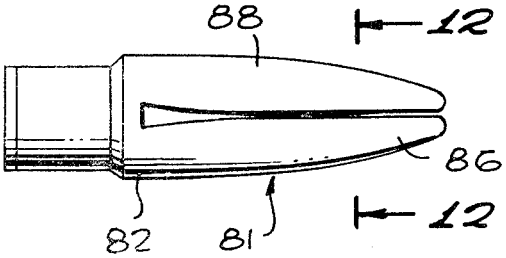
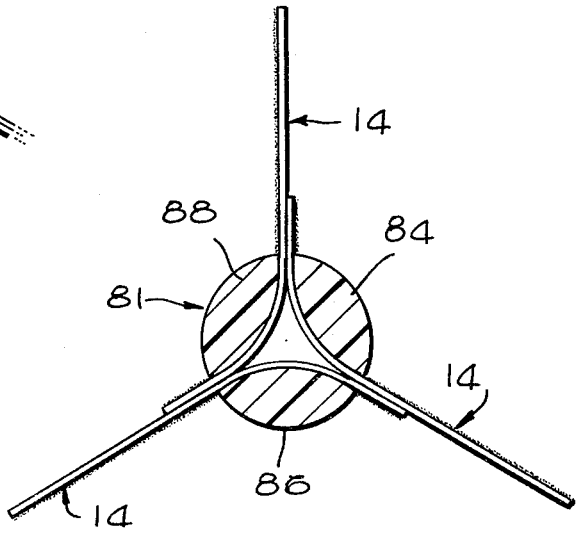
FIG. 12

FIG. 13
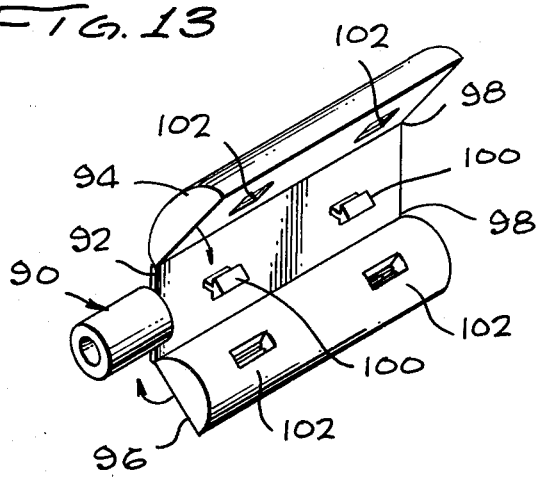
FIG. 14
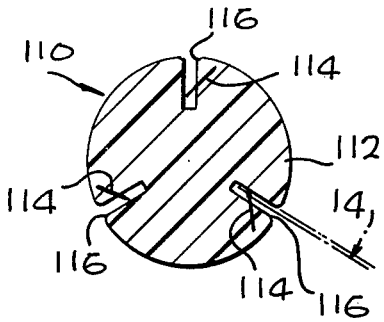
FIG. 16
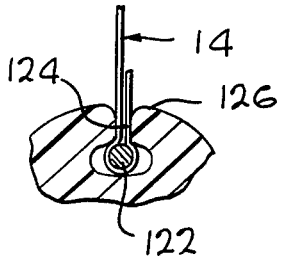
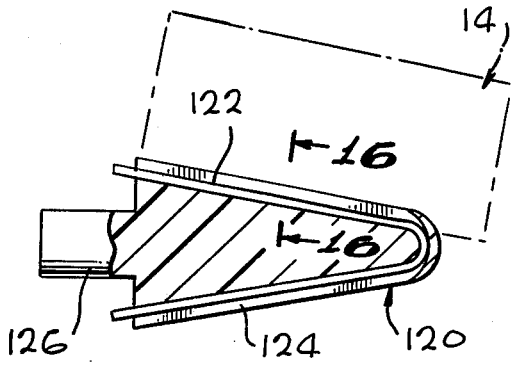
FIG. 15
FIG. 17
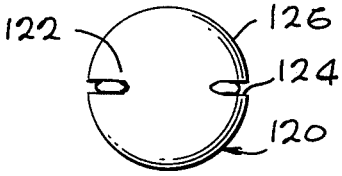
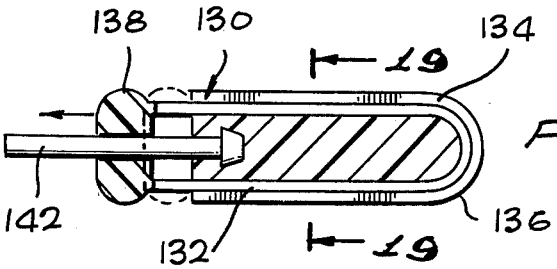
FIG. 18
FIG. 19
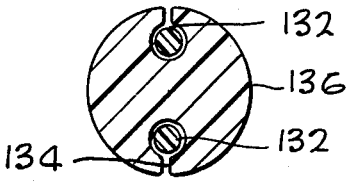
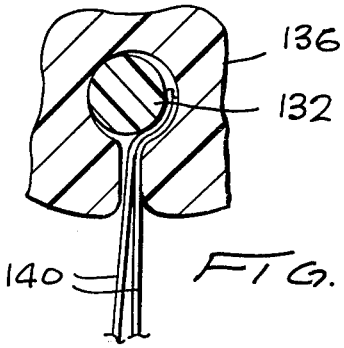
FIG. 20

ROTARY ABRASIVE TOOL

BACKGROUND OF THE INVENTION

This invention relates to apparatus for holding and rotating sheets of sandpaper or other abrasive, polishing or buffing material.

The mounting of sheets of sandpaper to a mandrel has required specialized disposable coupling members, or sheets of sandpaper with complex slots or holes, to hold the sandpaper sheets to the mandrel. U.S. Pat. No. 2,747,285 by Block, shows a device which utilizes special disposable retainers for coupling sandpaper sheets to a mandrel. U.S. Pat. No. 2,651,894 by Leggett shows a device which requires sheets of sandpaper with accurately formed slots at one end. Although the retainers or slotted sandpaper sheets can be made at low cost, they are specialized items that may not always be readily obtainable. Even in large cities, users often find it inconvenient to shop for retainers or specially fabricated sandpaper sheets when they are needed, especially if the need arises at night or on a holiday. Users of abrasive devices typically have sheets of sandpaper of various grades of roughness available and can easily cut them to a simple shape and size. It would be desirable if sheets of simple shape could be readily mounted on a mandrel, without the need for an intermediate retainer, expecially if the retainer is not reusable.

SUMMARY OF THE INVENTION

In accordance with one embodiment of the present invention, a rotary abrasive tool is provided which includes a mandrel that can be readily attached to a limited number of sheets of sandpaper or other wearing material of simple shape without the need for specialized retainer members that may not be readily available. The apparatus includes a rotatable mandrel with at least one longitudinal slot at its periphery. At least one sheet of abrasive or other wearing material is mounted on the mandrel by installation of its inner end in an interference fit in the slot of the hub member, and with at least one surface of the sheet of abrasive material engaging a wall of the slot. The slot can be undercut and a staple can be installed along the radially inner edge of sheets of wearing material to aid in retention of the sheets. The mandrel is constructed of a resilient material having an elasticity much greater than metals, and can be made of plastic or rubber. An end of the mandrel can be tapered, and the slot can be opened at the end nearest the tapered end of the mandrel, so that sheets of abrasive material can extend beyond the end of mandrel to enable them to deflect into a cone to sand small holes or the like.

The novel features of the invention are set forth with particularity in the appended claims. The invention will be best understood from the following description when read in conjunction with the accompanying drawings.

BRIEF DESCRIPTION OF THE DRAWINGS

FIG. 6 is a perspective view of a tool constructed in accordance with another embodiment of the invention, wherein rods are utilized to hold the inner ends of sandpaper sheets to the mandrel;

FIG. 7 is a view taken on the line 7—7 of FIG. 6;

FIG. 8 is a sectional view of a mandrel constructed in accordance with another embodiment of the invention, wherein a non-circular hole is utilized on the mandrel which can be forced to expand to tightly hold the sandpaper in the slots of the mandrel;

FIG. 9 is a side elevation view of the tool of FIG. 8, also showing the tapered spindle used with the mandrel of FIG. 8;

FIG. 10 is a view of the apparatus of FIG. 8, showing how it grips sheets of sandpaper;

FIG. 11 is a side elevation view of a tool constructed in accordance with another embodiment of the invention, which utilizes separate fingers that grip the sandpaper sheets;

FIG. 12 is a view taken on the line 12—12 of FIG. 11 but with sheets of sandpaper shown installed on the tool;

FIG. 13 is a perspective view of a mandrel constructed in accordance with another embodiment of the invention, wherein it includes portions that pierce the sandpaper sheets to hold them;

FIG. 14 is a sectional view of a tool constructed in accordance with another embodiment of the invention; which utilizes springs within the mandrel to hold sheets of sand-paper;

FIG. 15 is a sectional side view of a tool constructed in accordance with another embodiment of the invention, which utilizes a retainer spring that holds sheets of sandpaper to the mandrel;

FIG. 16 is a view taken on the line 16—16 of FIG. 15;

FIG. 17 is an outer end view of the tool of FIG. 15;

FIG. 18 is a sectional side view of a tool constructed in accordance with another embodiment of the invention;

FIG. 19 is a view taken on the line 19—19 of FIG. 18;

FIG. 20 is an enlarged view of a portion of the tool of FIG. 19, shown with sheets of sandpaper installed.

DESCRIPTION OF THE PREFERRED EMBODIMENTS

Figure 1:
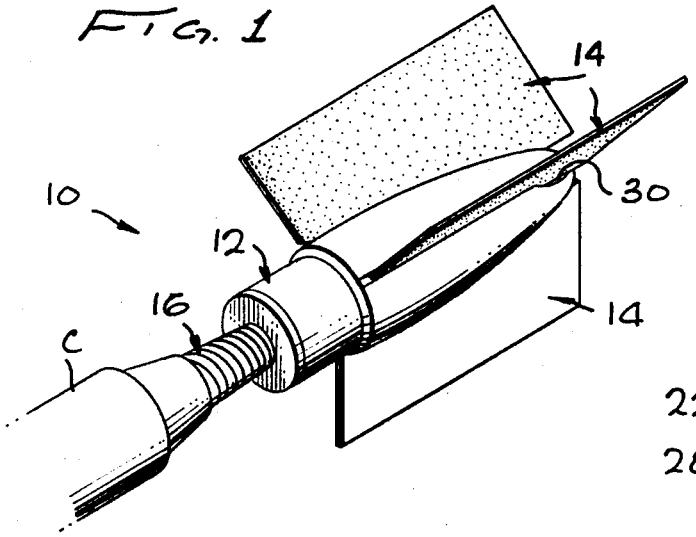
FIG. 1 is a perspective view of a rotary abrasive tool, constructed in accordance with one embodiment of the present invention.

FIGS. 1-4 illustrate a rotary abrasive tool 10 which includes a hub member or mandrel 12 for holding sheets of sandpaper 14 or other abrasive or polishing material, any of such materials sometimes referred to as wearing material.

The mandrel is held to the outer end of a tapered spindle 16 whose inner end can be held by a rotating device such as the collet C of a handgrinder.

The mandrel 12 is constructed of an elastic material such as plastic or rubber, and has three undercut slots 20,22,24 that can receive an end or edge portion **14*e* of sheets of sandpaper or other wearing material. Typically, several sheets such as 14*a*–14*c* of sandpaper are fastened together by a staple 26 along their edge portion 14*e* and are all installed in one of the slots such as 20**.

The staple 26 not only holds the sheets together, but also aids in retaining them in the undercut slot 20, the width of the staple 26 being greater than the throat portion 28 of the slot.

Figure 4:
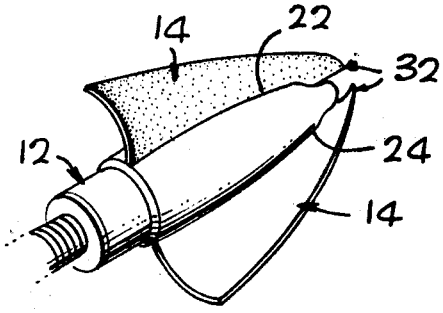
FIG. 4 is a side elevation view of the apparatus of FIG. 1, showing its manner of operation in sanding a surface of small radius of curvature.

The mandrel 12 is formed with a tapered outer end 12*o*, and the axially outer end 30 of each slot is open. The sheets 14 are installed with a considerable length thereof extending axially beyond the outer ends 30 of the slots, and even beyond the outer end of the mandrel. It has been found that this enables the wearing sheets 14 to deform to the surface of a cone rather than only a cylinder, as the sheets rotate. For example, the sheets can deflect into a cone shape with a small end 32, as shown in FIG. 4, which is very useful for sanding the inside of small openings or for concave regions of a small radius of curvature. This is particularly useful in jewelry work.

Although the sheets of sandpaper or other wearing material can be purchased in a condition wherein they are already cut to size and stapled in groups along their edges, it is also possible for the user to form his own sheets or groups of sheets. This is easily done using an ordinary stapler to hold the sheets together. Alternatively, a person can install the sheets by merely bending over the radially inner edges and inserting them into the slots. Although the sheets 14 can be formed as rectangles, an inclined surface 34 can be provided to facilitate installation of the sheets when sliding them axially into the outer ends of the mandrel slots. Also, the axially outer and radially outer edge of the sandpaper can be cut off, as along the line 35, to enable sanding in a small hole. The radial spacing of slots which results in spacing of sandpaper sheets, allows the user to view the workpiece as the mandrel rotates. Also if the type of abrasive is printed on the back of the sheets, the type can be read while the mandrel rotates.

Figure 5:
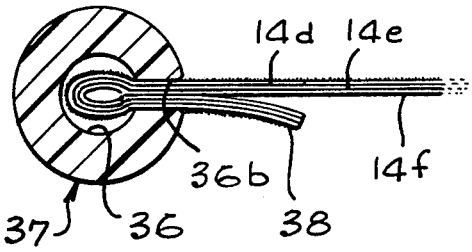
FIG. 5 is a sectional view of a tool constructed in accordance with another embodiment of the invention, wherein the mandrel has a single slot, and wherein the sandpaper is securely held by folding over its inner end.

FIG. 5 illustrates a group of abrasive sheets 14*d*, 14*e*, 14*f*, that have been installed in a slot 36 of a mandrel 37, by merely folding over their inner ends to form a folded-over portion 38 which lies in the slot. For the typical-wearing sheets having abrasive grains on only one side, the folding over is accomplished so that the abrasive sides of the sheets face both walls 36*a*, 36*b* of the slot. It has been found that this technique for installation of the abrasive sheets results in secure holding of the sheets to the rotating mandrel over an extended period of use. The interference fit of the abrasive sheet with the walls of slot 36, plus the fact that the grains of the abrasive sheet engage resilient material of which the mandrel is constructed, results in secure holding of the sheets. It is believed that the grains of the abrasive press into the walls of the slot of the mandrel, to provide a very high effective coefficient of friction that securely holds the sheets in place. It may be noted that the particular mandrel 37 is similar to the mandrel 12 of FIG. 1, except that the mandrel 37 has only a single slot. The single slot allows the sandpaper to extend to the axis of the tool, so the sandpaper can deform to a cone shape with a sharp point.

The spindle 16 has a tapered forward end 40 which is threaded. The mandrel is constructed with a tapered hole 42 designed to receive the threaded spindle. The hole 42 is initially constructed without threads, but threads are formed by the spindle when screwed therein. The threaded tapered spindle has been found to hold securely to the mandrel 12, for either direction of rotation of the mandrel. A band 44 of metal such as brass may be closely fastened around the axially inner end of the mandrel to prevent expansion and cracking when the tapered spindle is screwed into the mandrel.

Figure 3:
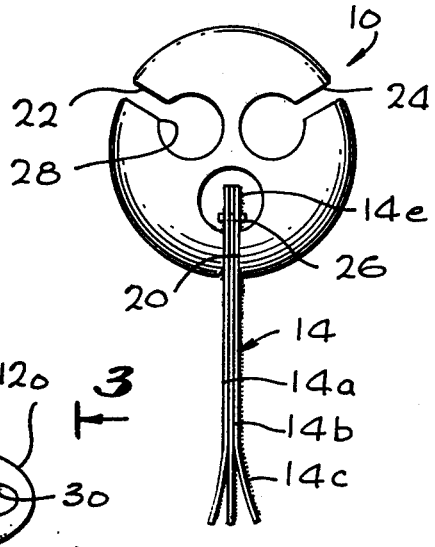
FIG. 3 is a view taken on the line 3—3 of FIG. 2.
Figure 2:
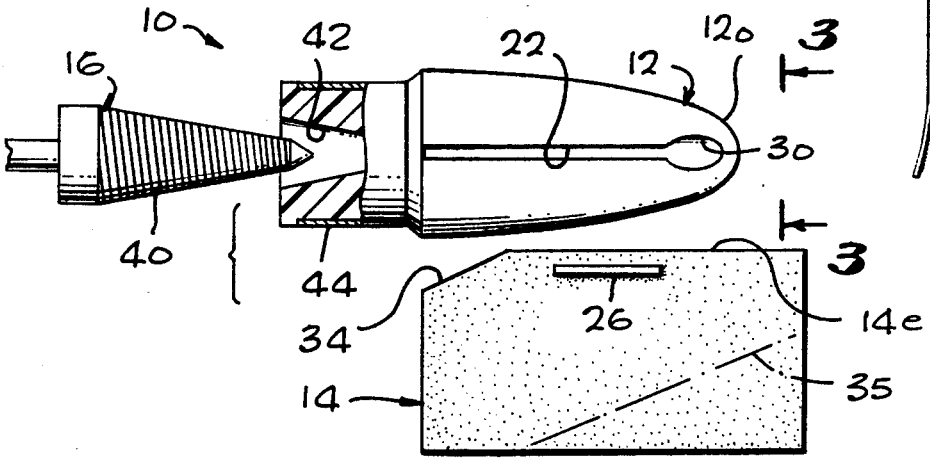
FIG. 2 is an exploded side elevation view of the tool of FIG. 1.

The mandrel 12 can be injection molded of a material such as high-density polyethylene, which has a Young's modulus of elasticity of about $0.1 \times 10^6$ which is 2 orders of magnitude less than the modulus of elasticity of typical metals such as brass (elasticity of $15 \times 10^6$) or steel (elasticity of $40 \times 10^6$). Thus, a material with an elasticity of on the order of $1.0 \times 10^6$ or less is preferably utilized for the mandrel. A variety of materials including several types of plastics and rubbers, have the required characteristics. The undercut slot preferably has a throat portion with substantially flat walls, as shown in FIG. 3, to provide a considerable area into which the sandpaper grains can deform. Also, the slot forms an approximately 90° edge at 28 where the throat intersects the slot portion lying within the throat.

FIGS. 6 and 7 illustrate another tool 50 similar to that of FIG. 1, but wherein rods 52 are utilized to securely hold one or more sheets 54 of wearing material to the mandrel 56. The inner edge portion of the sheet is folded over, and the rod 52 is positioned in the fold. The folded sheet portion with the rod therein can be installed by merely sliding it axially into the outer end of the slot.

FIGS. 8–10 illustrate another rotary abrasive tool 70 which utilizes a mandrel 72 having a triangular axial hole 74 which receives the tapered spindle 16. The mandrel also has three slots 76, 78, 80 for receiving sheets 14 of sandpaper. The triangular hole and slots are formed so that the hole has a greater radius $R_1$ at a location immediately within the slots than the radius $R_2$ on either side of the location within the slot. Accordingly, as the tapered spindle 16 is threaded into the triangular hole, it bears against the walls of the hole at locations on either side of the slot 76. The mandrel 72 is formed of resilient material and the tapered spindle will cause the walls of the slot 76 to close, as shown in FIG. 10, to tightly grip the sheets 14 of sandpaper therein. The mandrel will then be deformed to a more rounded shape as shown at 72A.

FIGS. 11 and 12 illustrate another tool 81, wherein the mandrel 82 has intersecting slots forming three fingers 84, 86, and 88. The mandrel is constructed of elastic material such as high-density polyethylene, and the fingers are tightly biased against one another. Sheets 14 of sandpaper are installed by slipping one end portion of the sheets around the inside of one of the fingers. When three groups of sandpaper sheets are installed, they lie on one another, as illustrated in FIG. 12. It has been found that these sheets hold stably to the mandrel when the mandrel rapidly rotates, and when the workpiece is pressed against the tool.

FIG. 13 illustrates another rotary abrasive tool which utilizes a mandrel 90 formed of three parts 92, 94, and 96 that are hingably joined by forming narrow sections 98 between a middle part 92 and each of the other parts 94, 96. The middle part 92 includes a pair of upstanding barbs 100 extending from opposite faces of the middle part, which can be received in corresponding slots 102 formed in each of the outer parts 94, 96. The edge portion of one or more sheets of sandpaper are laid on each side of the middle part 92, and the outer parts 94, 96 are then closed on the middle part so that the barbs 100 penetrate the sandpaper sheets to hold them in position.

FIG. 14 illustrates still another rotary abrasive tool 110 wherein the mandrel 112 is formed with leaf springs 114 that have one end captured in the mandrel and an opposite free end extending radially inwardly into a slot 116 formed in the mandrel. When sheets of sandpaper are pushed into the slots, the springs 114 bear against the sheets and prevent their removal by centrifugal force or the pressure of the workpiece. The sheets can be intentionally removed by sliding them axially out of the mandrel slot.

FIGS. 15–17 illustrate still another rotary abrasive tool 120 wherein a spring rod 122 lies in grooves 124 of a mandrel 126 to hold in sheets of sandpaper.

FIGS. 18–20 illustrate yet another rotary tool, wherein an elastomeric retainer 130 has an elongated portion 132 that lies in slots 134 of the mandrel 136. When a knoblike portion 138 of the retainer is pulled as shown in FIG. 18, it causes the elongated portion 132 to stretch and therefore to contract in diameter. The edges of sandpaper sheets 140 then can be slipped into the undercut portion of the slot. When the knob-like portion is released, the elongated portion 138 expands to hold the sandpaper sheets tightly in place. A shaft 142 is molded into the mandrel.

Thus, the invention provides rotary abrasive tools of simple construction that can directly hold sheets of sandpaper, to avoid the need for precision cut sheets or disposable special intermediate coupling parts to hold the sandpaper to the mandrel. This is accomplished in some of the mandrels, by merely holding the sheets of sandpaper in an interference fit with the mandrel. This can be accomplished by constructing the mandrels so that sheets of sandpaper can be installed with their abrasive sides facing at least one slot wall of the mandrel, and by constructing the mandrel of an elastic material which will be deformed by the grains of the sandpaper, to securely hold on the sandpaper. In one embodiment of the invention, sheets of sandpaper are securely held in a slot of the mandrel by an interference fit therewith, and with a staple joining the sheets of sandpaper together and providing additional holding power by reason of the staple lying in the undercut portion of the mandrel slot. In this embodiment of the invention, the sheets of sandpaper also can be installed by folding over their inner ends so that sandpaper engages both sides of the mandrel slot. Each of the mandrels is constructed with grooves that are open at the axially outer ends of the slots, and with the mandrel preferably being tapered, which enables the sandpaper sheets to be installed so that they extend beyond the mandrel. This enables the sandpaper sheets to deflect into a cone shape to sand small-diameter concave regions of a workpiece.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for rotating small sheets of abrasive material, comprising:

an elongated hub member rotatable about a predetermined axis and having a plurality of elongated undercut slots radially spaced from but located near said axis and extending along the length direction of said hub member, said hub member having a shaft-engaging first end and a tapered opposite end, and said slots being open at the end nearest the smallest diameter of the hub to allow an abrasive sheet to extend axially beyond the slot.

2. The apparatus described in claim 1 including:

a plurality of small sheets of abrasive paper forming a sheet stack having an inner edge; and a staple fastening the edge portion of said sheets together which lie near said edge of said sheet stack, said staple being close enough to said edge to fit in one of said undercut slots together with the portion of the sheets which lie between the staple and said edge, said sheet stack containing only sheets of abrasive paper and to a thickness which closely fits in the throat of one of said undercut slots, and portions of said staple extending above and below the stack to provide a thickness that cannot pass through the throat of the slot.

3. Apparatus for holding and rotating sheets of abrading material, comprising:

a mandrel rotatable about a predetermined axis and having at least one slot in its periphery, said mandrel being formed of resilient material and having walls forming a hole of noncircular cross-section along said axes, said hole having a greater radius as measured from the axis of said mandrel, at a location immediately within said slot than at areas on either side of said location; and a threaded spindle member closely receivable in said hole in an interference fit therewith, to press against the walls of said hole at said areas on either side of said location, whereby to close said slot to lock a sheet of abrasive material therein.

4. Apparatus for rotating small sheets of sandpaper material, comprising:

a hub member constructed of a thermoplastic-like material into which grains of sandpaper can deform, and rotatable about a predetermined axis, said member having a plurality of undercut slots spaced from and about said axis, each slot having a throat portion which has substantially flat opposite walls to provide a considerable area into which sandpaper grains can deform;

said hub member having a shaft-engaging end and an opposite tapered end, said slots being open at the ends thereof opposite said shaft-engaging end to allow sheets of sandpaper to extend axially beyond the slot, and said hub member being tapered along most of the length of said slots.

5. Apparatus for rotating small sheets of abrasive material, comprising:

an elongated hub member rotatable about a predetermined axis and having at least one elongated undercut slot located near said axis and extending along the length direction of said hub member, said hub member having a shaft-engaging first end and a tapered opposite end, and said slot being open at the end nearest the smallest diameter of the hub member to allow an abrasive sheet to extend axially beyond the slot.

* * * * *